US011497326B2

(12) United States Patent
Peiper et al.

(10) Patent No.: US 11,497,326 B2
(45) Date of Patent: Nov. 15, 2022

(54) DEVICE FOR DISPLAYING AND DEMONSTRATING A HAIR SWITCH

(71) Applicant: The Procter & Gamble Company, Cincinnati, OH (US)

(72) Inventors: Matthew William Peiper, Loveland, OH (US); William Allen Watters, Foster, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 363 days.

(21) Appl. No.: 15/928,538

(22) Filed: Mar. 22, 2018

(65) Prior Publication Data

US 2019/0290025 A1 Sep. 26, 2019

(51) Int. Cl.
*A41G 3/00* (2006.01)
*A47F 7/06* (2006.01)

(52) U.S. Cl.
CPC ..... *A47F 7/065* (2013.01)

(58) Field of Classification Search
CPC ..... A45D 44/14; A47F 7/06; A47F 7/065; A41G 3/00
USPC ..... 434/377
See application file for complete search history.

(56) References Cited

U.S. PATENT DOCUMENTS

| | | | | |
|---|---|---|---|---|
| 2,318,774 | A * | 5/1943 | Goldsmith | A47F 8/02 434/399 |
| 2,323,522 | A | 7/1943 | Journette | |
| 3,698,134 | A | 10/1972 | Amici et al. | |
| 3,903,640 | A | 9/1975 | Dunn | |
| 4,874,345 | A | 10/1989 | Dirks | |
| 7,775,377 | B2 | 8/2010 | Abney | |
| 2012/0097831 | A1* | 4/2012 | Olukotun | F16M 11/041 248/688 |

FOREIGN PATENT DOCUMENTS

EP 1839526 A1 * 10/2007 ..... A45D 44/14

OTHER PUBLICATIONS

"How Much Clamping Force Do I Need to Hold This Part?" Vektek, https://web.archive.org/web/20080513150757/http://www.vektek.com/fixhowmuch.aspx, May 13, 2008 (Year: 2008).*
"G140K Mechanical Vice Grip," Test Resources, https://web.archive.org/web/20170703214438/https://www.testresources.net/accessories/grips-fixtures/tensile-grips/mechanical-vice-action-grips/g140k/, Jul. 3, 2017 (Year: 2017).*

* cited by examiner

*Primary Examiner* — Kesha Frisby
(74) *Attorney, Agent, or Firm* — Linda M. Sivik

(57) ABSTRACT

The present invention is directed towards providing a device for displaying and demonstrating hair switches. The device is useful for showing the benefits and effects of hair products on the hair in an aesthetical pleasing manner. The device can be readily assembled and disassembled for efficient storage and transportation and it enables a rapid attachment and removal of a hair switch for efficient product evaluation, display and demonstration.

11 Claims, 5 Drawing Sheets

DEVICE FOR DISPLAYING AND DEMONSTRATING A HAIR SWITCH

FIELD OF THE INVENTION

A device for displaying and demonstrating hair switches. This device is useful for showing the benefits and effects of hair products on the hair. The use of this device may overcome the barriers, including physical and psychological, associated with demonstrating on a hair switch.

BACKGROUND OF THE INVENTION

In the cosmetic industry hair switches are used for various purposes. During product development for hair care products, the performance of new compositions is evaluated by treating hair switches with the compositions and comparing the resulting hair properties with hair switches that are treated with existing standard products. Successful compositions result in improved hair features such as cleanness, feel, shine, color and/or styling versus hair that are treated with existing product controls. Hair treatments require attaching the hair switches securely on a holding device, typically a ring stand or a horizontal rod having a clamp, which allows the researcher to manipulate the hair as the treatment protocol requires. Typical evaluations include one or more of the following steps (a) applying the product, (b) massage onto the hair, (c) rinse, (d) dry with a blow drier or a hot iron, etc. Popular treatments include washing with shampoo, treating with rinse off or leave-on conditioner, treating with temporary styling product, treating with a semi-permanent or permanent styling product, coloring with temporary, semi-permanent or permanent coloring product, etc. Some of these products include a set of compositions and some of the treatments involve multiple treatment steps. For each evaluation, a multiple of similar hair switches are treated with the same new product composition and with control product compositions in order to allow for statistical analysis of the results. From the above description, it becomes apparent that hair care treatment evaluations can be labor-intensive and time-consuming. The researcher must rapidly and efficiently remove the hair switch from the place where it is attached and replace it with another switch. In addition, the switch must be securely attached onto the holding device so it will not be removed or become loose during the treatment. The determination of the hair features achieved by a particular treatment may also require an appropriate display of the treated switch so that the person performing the evaluation has an effective view of the switch and also has the ability to comb or to feel the hair switch with their hands.

Ring stands or horizontal rods with simple clamp attachment elements are typical holding devices used in labs. These are inexpensive and easy to construct. However, they pose some challenges for those who use them. The clamps may not have the proper holding force and the base of the ring stand may not provide the appropriate stability for the occasionally forceful manipulations required by some testing protocols. In terms of displaying the switches, the typical set up also results in challenges. The aesthetics of the device are not ideal, the switch may not be readily spread in the width dimension to allow for an effective view of its visual evaluation for color, shine and style. The latter feature of the typical display device is even more inadequate when hair switches are used for demonstrating hair care performance to merchants during marketing activities by product manufacturers or for store demonstration to consumers.

Thus, there is a need for an effective and efficient hair switch holding device, which can be used for product testing and evaluation and which is aesthetically pleasing, presenting the hair in a context that the viewer will readily relate to. The device of the present invention marries the ease of use of the horizontal rod and clamp with the aesthetic value and context of the mannequin head. Hereafter, the present invention device is referred to as "the device".

The present invention surprisingly found a solution that provides a significant improvement. The invention involves a device for displaying and demonstrating a hair switch comprising a. a body comprising a two-dimensional silhouette, having an upper and a lower end, a middle section, and a front and back side;
b. An attachment element which is selected from a group consisting of a clamp, hook, adhesive, pin, screw, and nut and bolt;
c. A spreading element which is selected from the group consisting of a clamp pin, adhesive, and cap and groove
d. A base;

wherein the attachment element is located on the front of the body, the back of the body, or the upper or lower end of the body;

and wherein the spreading element for the hair switch is located on the front of the body, the back of the body, or the upper end of the body;

and wherein the lower end of the body is attached to the base;

and wherein the closed end of the hair switch is attached to the attachment element;

and wherein the hair switch is guided through the spreading element to be demonstrated in the desired width.

The device for displaying and demonstrating hair switches enables rapid and efficient changing of hair switches. It is able to withstand sufficient force applied during treatment and evaluation. Its base, can be designed to be securely attached to a surface to provide sufficient stability. The spreading element provides appropriate display of the treated switch so that the person performing the evaluation has an effective view of the hair switch and also has the ability to comb or to feel the hair switch with their hands. It can be designed to be disassembled and stored in a compact package, making it portable. More importantly, the device can be designed to resemble familiar objects, such as a human body, human head, animal body, animal head, plant, or building. A user can design the device to be beautiful, engaging, and imaginative, providing context and engaging the viewer on a more emotional level.

SUMMARY OF THE INVENTION

The present invention relates to a demonstration device for demonstrating hair products and techniques on hair switches. The hair switch and the device create an integral image. The device helps to provide context for the demonstration, making it more attractive to the observer, as opposed to traditional means of demonstrating hair switches, which are limited to simple stands. For a non-limiting example, the device may look like or represent a human head, and the hair switch appears to grow from the head. The device may be used for in-store displays to illustrate the beneficial features of specific hair products to consumers, or for live demonstrations of the use or results of hair products.

The present invention is directed to a device for displaying and demonstrating a hair switch comprising a body comprising a two-dimensional silhouette, having an upper and a lower end, a middle section, and a front and back side; an attachment element which is selected from a group consisting of a clamp, hook, adhesive, pin, screw, and nut and bolt; a spreading element which is selected from the group consisting of a clamp, pin, adhesive, and cap and groove; and a base; wherein the attachment element is located on the front of the body, the back of the body, or the upper or lower end of the body; and wherein the spreading element for the hair switch is located on the front of the body, the back of the body, or the upper end of the body; and wherein the lower end of the body is attached to the base; and wherein the hair switch has an open end and a closed end; and wherein the closed end of the hair switch is attached to the attachment element; and wherein the hair switch is guided through the spreading element to be demonstrated in the desired width.

DETAILED DESCRIPTION OF THE INVENTION

Figure 1:
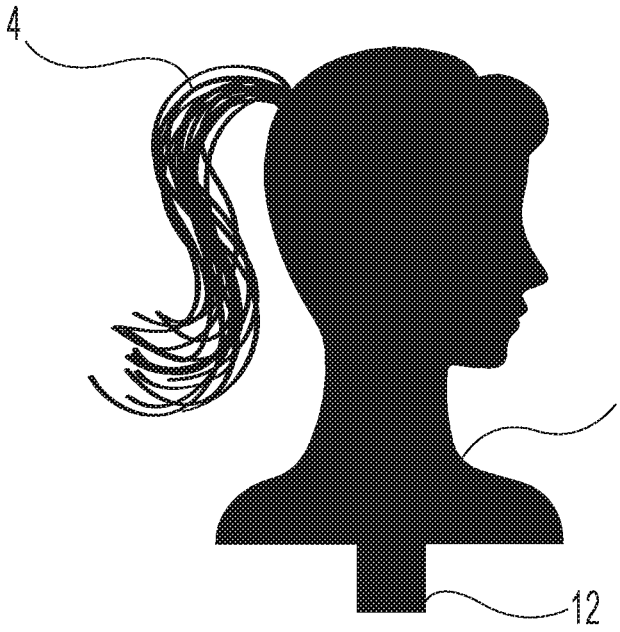
FIG. 1 shows the front side of the body (1) of the device. In this non-limiting example, the device is in the shape of a human head, neck and shoulders.

While the specification concludes with claims which particularly point out and distinctly claim the invention, it is believed the present invention will be better understood from the following description.

As used herein, "two-dimensional silhouette" as used in reference to a device, means an article having the following dimensions: (a) height of about 2.5 cm to about 100 cm, (b) width of about 0.2 cm to about 20 cm, (c) depth of 0.1 cm to about 2 cm.

As used herein, "three-dimensional sculpture" as used in reference to a device means an article having the following dimensions: (a) height of about 2.5 cm to about 100 cm, (b) width of about 0.2 cm to about 20 cm, (c) depth of about 2 cm to 20 cm.

As used herein, "building" as used in reference to a device means a building, part of a building or an element or architectural feature of a building.

As used herein, "hair switch" as used in reference to the current invention means a bundle of fibers having the following dimensions: (a) height of about 2.5 cm to about 90 cm, (b) width of about 0.2 cm to about 20 cm, (c) depth of about 0.1 cm to about 3 cm, wherein the fibers are gathered and fastened at one end.

As used herein, "closed end" as used in reference to the current invention indicates the end of the hair switch which is gathered and fastened.

As used herein, "clamp" as used in reference to the current invention indicates a device designed to bind or constrict or to press two or more parts together so as to hold them firmly.

As used herein, "hook" as used in reference to the current invention indicates a curved or bent component for catching or holding an item.

As used herein, "adhesive" as used in reference to the current invention refers to a substance used for sticking objects or materials together.

As used herein, "pin" as used in reference to the current invention refers to a piece of metal or other material having a depth and width from about 0.05 cm to about 3 cm.

As used herein, "cap and groove" as used in reference to the current invention refers to a system that comprises a cap, which is a hollow-bodied piece made to spread the switch, and a groove, which is a cut or depression which guides the switch from the back of the body to the front of the body, and positions the switch for spreading.

As used herein, "base" refers to the part of the device which supports the device on a surface.

As used herein, "slot" is an opening or a gap in the base having a height of from about 1 cm to about 8 cm. The slot has width from about 1 cm to about 8 cm and depth from about 0.1 cm to about 2 cm.

As used herein, "fugitive glue" refers to an adhesive which can be placed and removed as desired, leaving little or no residue, providing a secure, but temporary hold.

As used herein, the plane of the surface on which the device is placed is defined by the X and Y axes of the Cartesian Coordinates System. The Z-axis is the axis perpendicular to the plane defined by the X and Y axes. Herein, the Z-axis is also called "vertical axis".

Figure 5:
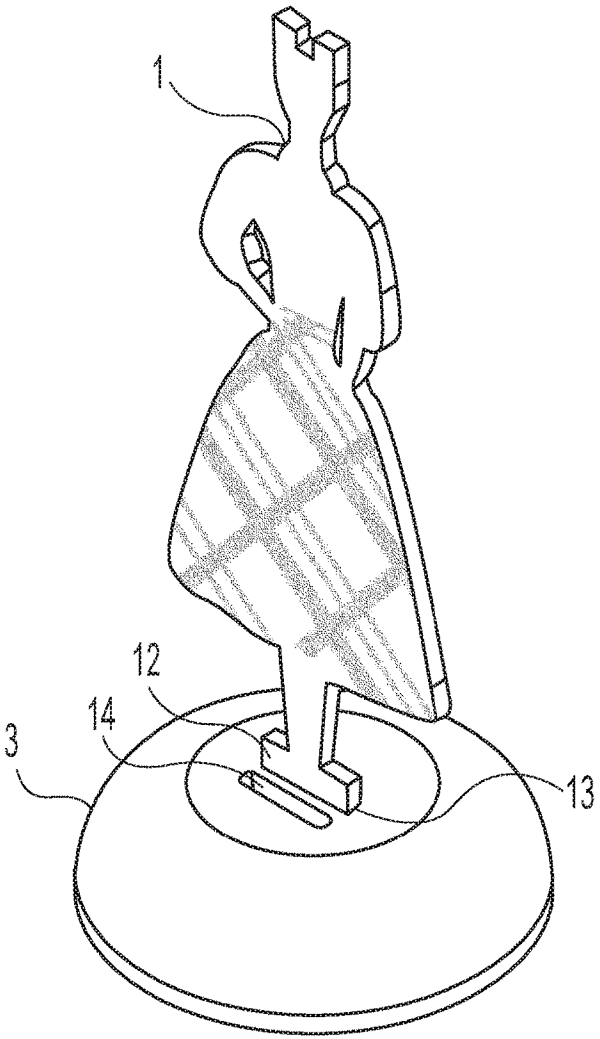
FIG. 5 shows the front side of the body (1) of the device standing in the base (3), held parallel to vertical plane by inserting the tab (12) into the vertical slot (13). There is another, non-vertical slot (14) wherein the body can be inserted at a different angle in relation to the plane of the surface on which the device is placed.
Figure 4:
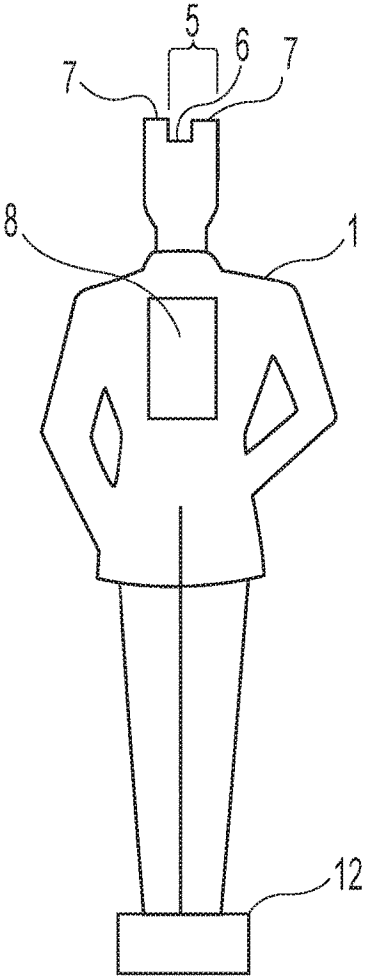
FIG. 4 shows the back side of the body (1) of the device showing the groove (5), which comprises the hollow part of the groove (6), and the vertical components of the groove (7), the position of the clamp (8), which is a non-limiting example of an attachment element, and the tab (12) which inserts into the slot of the base.
Figure 7:
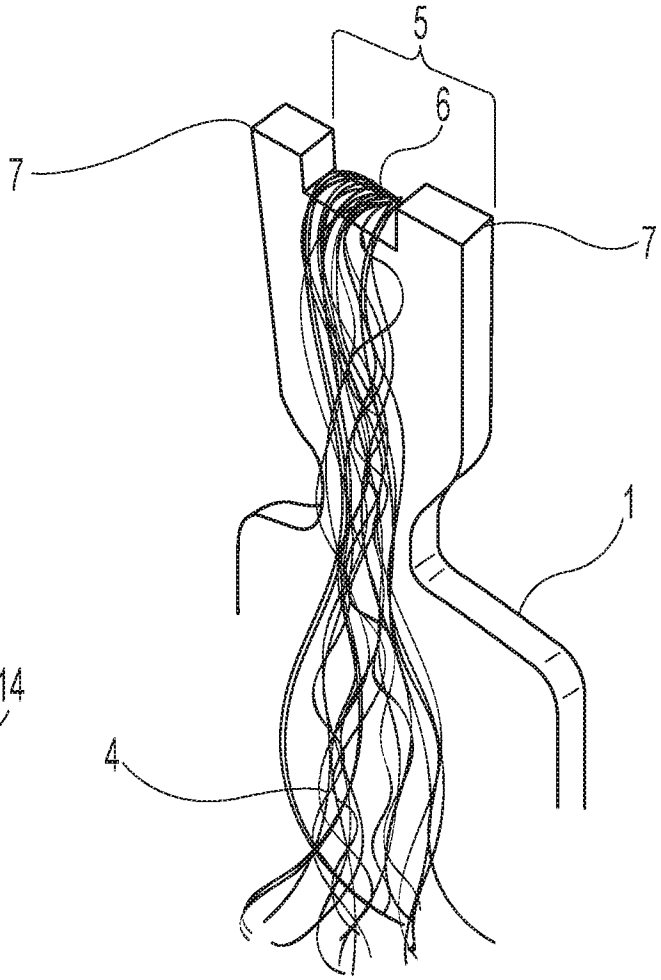
FIG. 7 shows a top view of the device, showing the body of the device (1) and how the hair switch (4) fits in the groove (5) by passing the hair switch through the hollow part of the groove (6) as defined by the two vertical components of the groove (7).

As used herein, "vertical slot" means that the slot in the base of the device is perpendicular to the plane of the surface on which the device is placed. A non-limiting example of a vertical slot (13) is shown in FIG. 5.

Figure 6:
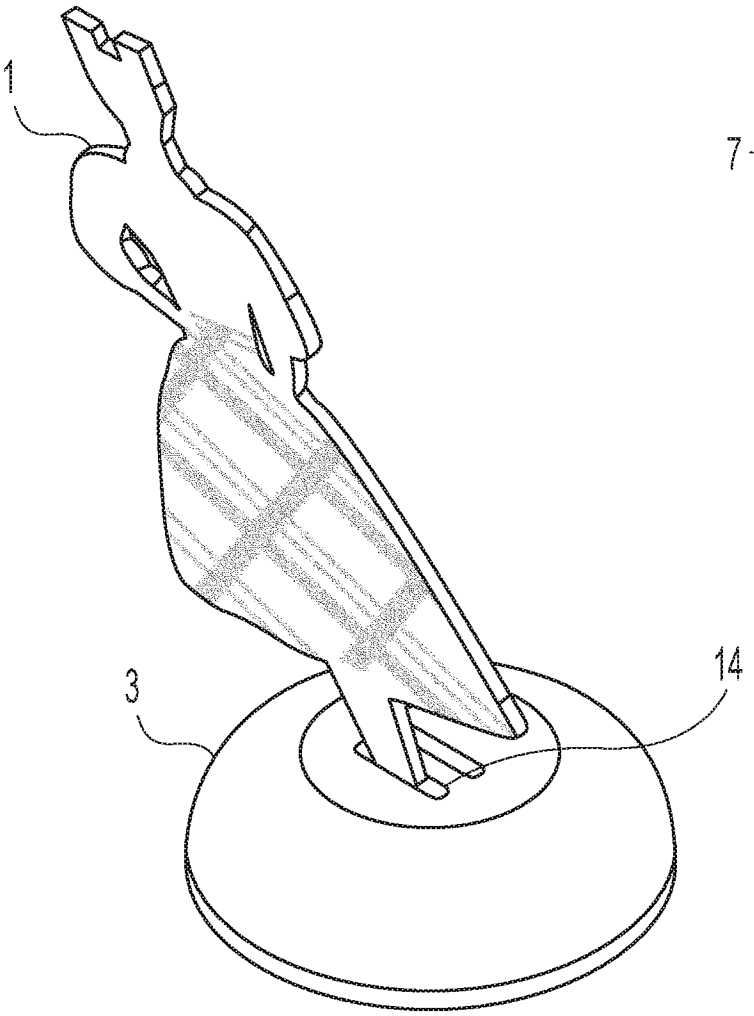
FIG. 6 shows the front side of the body (1) of the device standing in the base (3) at an angle to the vertical plane, by inserting the tab (12) into the non-vertical slot (14).
Figure 8:
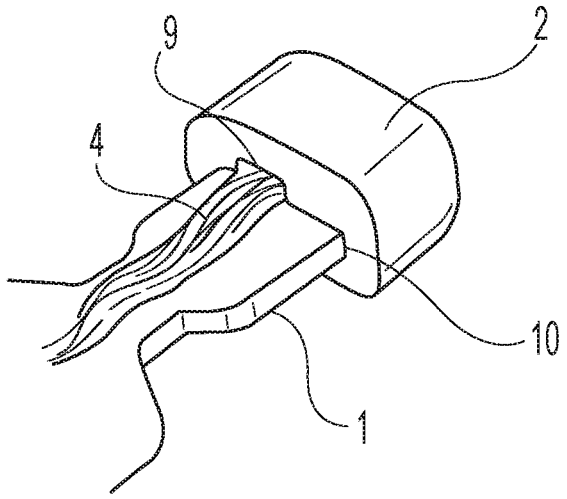
FIG. 8 shows a bottom view of the device, showing the back side of the device, demonstrating how the cap (2) fits onto the groove, which is located on the upper end of the body (1) of the device, and how the hair switch (4) is accommodated.
Figure 9:
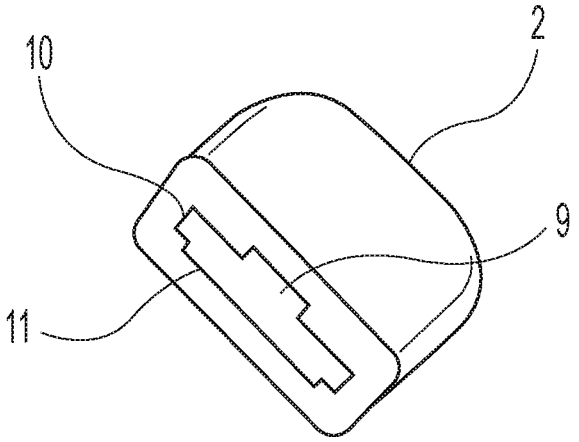
FIG. 9 shows a bottom view of the cap (2), showing (a) the rear concavity (9) for concealing the hair switch and acting as a path of the hair switch from the attachment element into the groove of the spreading element, (b) the front concavity (11) for spreading the hair switch on the front of the body, and (c) the middle concavity (10) for fitting the cap on the groove portion of the spreading element, allowing the cap to sit on the groove. Rear concavities (9), middle concavity (10), and front concavity (11) comprise the total concavity of the cap.

As used herein, "non-vertical slot" means that the slot in the base of the device is at an angle which is different than 90 degrees in relation to the plane of the surface on which the device is placed. A non-limiting example of a non-vertical slot (14) is shown in FIG. 6.

As used herein, the front side of the body (1) is the side of the body where the hair switch is demonstrated or displayed. The back side of the body (1) is the side of the body which may hold the attachment element. A non-limiting example of an attachment element is shown in FIG. 5 wherein clamp (8) is an attachment element.

Non-limiting examples of materials that can be used for the two-dimensional silhouette or the three-dimensional sculpture, or the cap and groove, or the base include wood, thermoplastic or thermoset polymer, glass, laminate, arboron or derivatives, rubber, metal, ceramic, concrete, and combinations thereof. The device may reflect realistic colors and shading, or incorporate a fanciful or imaginative use of color.

A non-limiting example of the base is a hemisphere having slots drilled in the top, to accept the lower end of the body of the device and wherein the bottom part of the base is the flat portion of the hemisphere. The slots may vertical slots, that is, they may be drilled in such a way that they hold the body of the device perpendicular to the plane of the surface on which the device is placed, which is the plane defined by the X and Y axes. The slots may be non-vertical slots, that is, they may be drilled in such a way that they hold the device non perpendicular (at an angle) to the plane of the surface on which the device is placed.

When demonstrating products or techniques on hair switches, the operator ideally may have a rapid and efficient way to secure a hair switch, demonstrate the desired protocol, and then replace the used switch with a fresh switch. During the demonstration, the operator may do any of the following, including, but not limited to, applying product, rinsing the switch with water, combing, brushing, drying, and styling. Conventional methods for demonstrating products and techniques on hair switches involve ring stands, racks and clamps. However, clamps may not provide the required holding force, and they may not permit the hair to be spread in a manner resembling hair on a person's head. Conventional mannequin heads may be bulky, hard to transport, and difficult to secure to a work surface.

The device has been designed in such a way that the operator can quickly install a hair switch. The device holds the hair switch securely for the duration of the demonstration, including, but not limited to any of the aforementioned treatments. Once the operator is ready to demonstrate on a new hair switch, the previous hair switch can be quickly and easily removed and a new one installed.

The device is also easy to assemble, disassemble, and transport. The device may be assembled by inserting the body into the base, attaching the closed end of the hair switch to the attachment element, passing the switch through the spreading element, and attaching the cap, if a cap is used. The desired width of the hair switch may be from about 0.4 cm to 30 cm, further from about 0.6 cm to about 5 cm, further from about 0.8 cm to about 2 cm. At this point the device is ready for use. To disassemble, the operation can be reversed. The ability to disassemble the device down into component pieces permits the user to store multiple devices in a very small space. For a non-limiting example, if the user chooses to use three devices with bases measuring 4 inches in diameter, and one inch high, the user can fit the all three of the devices in a 12"×4"×2" box, or 96 cubic inches, despite the fact that the three devices assembled require 12"×4"×4", or 192 cubic inches each, for a total of 576 cubic inches.

Thus, the device diverges from conventional methods by (a) offering a means of attachment which permits both quick changing of the hair and demonstrations requiring exertion of force, (b) facilitating easy transportation, (c) enabling rapid change of the hair switch: the hair can be removed from the device and a new specimen installed, ready for full demonstration. In addition, the present invention provides an aesthetically pleasing way to demonstrate hair switches.

EXAMPLES

A non-limiting example of the device is a two-dimensional silhouette which resembles a human body with a vertically arranged clamp on the back of the body, so the switch appears to naturally come out of the device's head (FIG. 3, FIG. 4, FIG. 7, FIG. 8). For a non-limiting example, FIG. 3 demonstrates a two-dimensional silhouette of a woman showing the front of the device, wherein the clamp is in the back of the device, and wherein the closed end of the switch is attached to the clamp, and wherein the hair switch passes through the cap and groove, allowing the open end of the hair switch to be displayed in a manner that permits viewing and demonstration.

Figure 2:
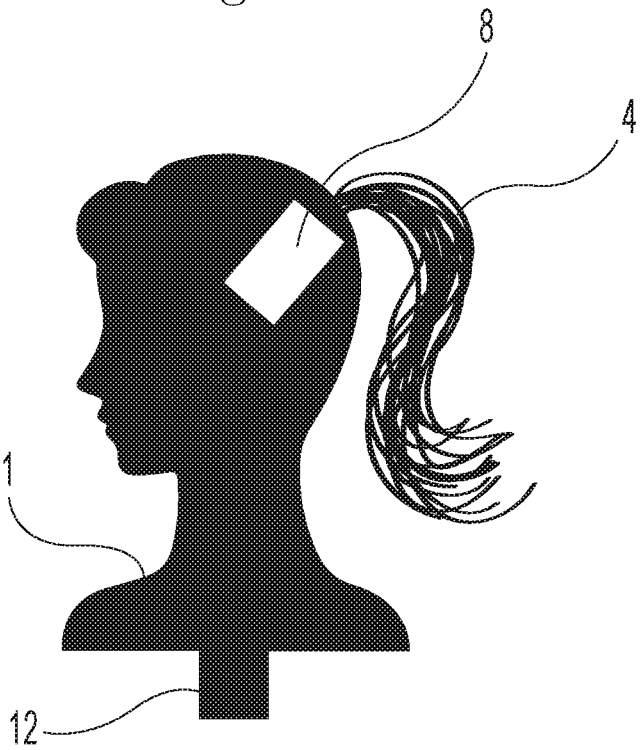
FIG. 2 shows the back side of the body (1) of the device. In this non-limiting example, the device is in the shape of a human head, neck and shoulders. The figure shows the position of the clamp (8) on the back of the body (1) of the device for holding and positioning the hair switch (4).
Figure 3:
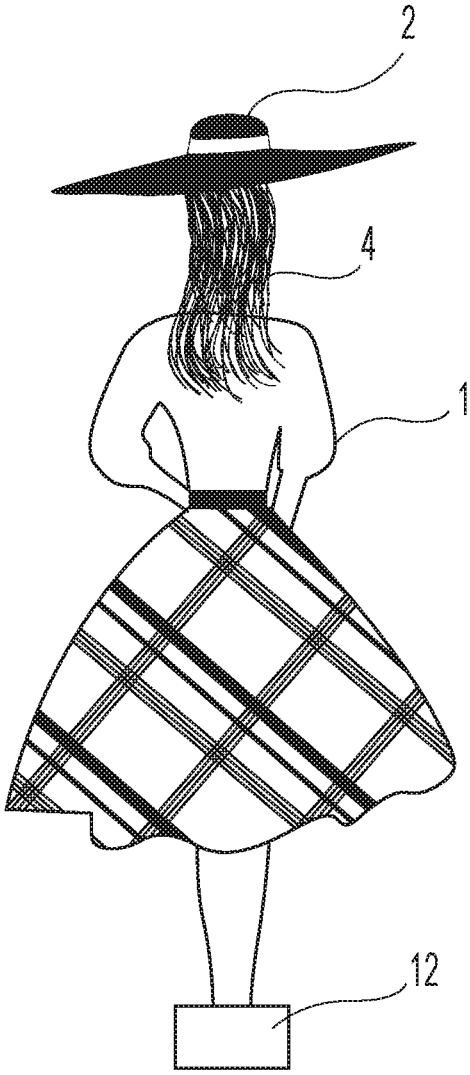
FIG. 3 shows the front of the body (1) of the device showing the cap (2) and hair switch (4), the tab (12) which can be inserted into the slot of the base, and demonstrating how the hair switch (4) is spread.

A non-limiting example of the device is a two-dimensional silhouette which resembles a human head, neck, and shoulders, with a clamp arranged on the back of the body of the device so the switch appears to naturally come out of the device's head, as seen in FIG. 1 and FIG. 2. This device can give the perception of a ponytail defined by the hair switch (4), as shown in FIG. 2, wherein the clamp is arranged in such a way that the hair switch (4) is held at a 30° angle to the horizontal axis.

Another non-limiting example of the device is a two-dimensional silhouette shaped like a building having a window, with a clamp arranged on the back of the body of the device to make the switch appear to descend down the side of the building from the window.

Another non-limiting example of the device is a three-dimensional sculpture resembling a human head with a clamp arranged on the top of the head to hold one or more switches, with a hat-shaped cap on top of the head to give the appearance of hair coming naturally out of the human head. Alternatively, instead of being placed on the top of the head, the clamp can also be located in the cap.

Figure 10:
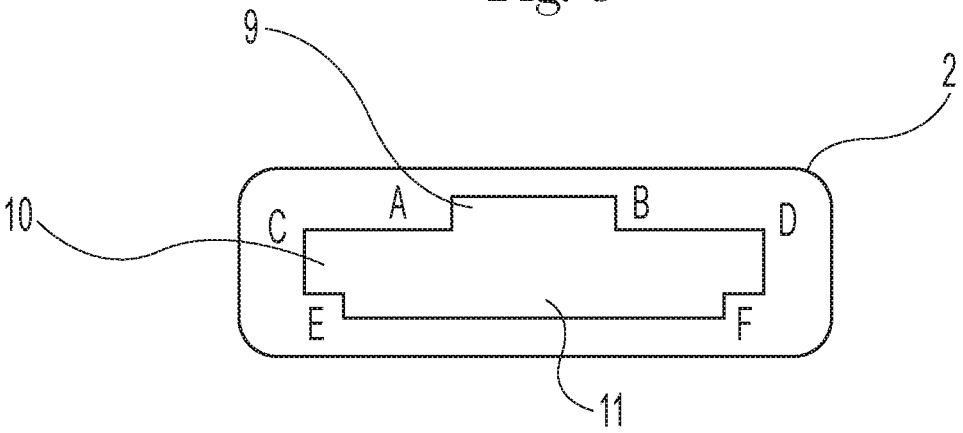
FIG. 10 shows a bottom view of the cap (2), showing the rear concavity (9) for concealing the hair switch and the front concavity (11) for spreading the hair switch front of the body, and the middle concavity (10) for fitting on the groove.

A non-limiting example of the spreading element is a cap and groove. The groove can be located in the upper end of the body of the device. The cap and groove work together to spread the hair switch, readying it for display or demonstration. The cap comprises three concavities. These concavities serve various purposes as seen in FIG. 10. The rear concavity (9) conceals the hair switch and acts as a path of the hair switch from the attachment element (clamp) into the groove of the spreading element. The front concavity (11) guides the hair to spread out to the desired width. The middle concavity (10) fits on the groove portion of the spreading element, allowing the cap to sit on the groove at the top of the device. FIG. 10 shows a non-limiting example of a cap, having a rear concavity (9), a front concavity (11) and a middle concavity (10).

A non-limiting example of the base (3) is a hemisphere having vertical slot (13) and non-vertical (14) drilled in the top, to accept the tab (12) of the body of the device. The slots may be vertical slots, that is, they may be drilled in such a way that they hold the body of the device perpendicular (13) (FIG. 5) to the plane of the surface on which the device is placed, which is the plane defined by the X and Y axes. The slots may be non-vertical slots, that is, they may be drilled in such a way that they hold the device non perpendicular (14) (FIG. 6), that is, at an angle to the plane of the surface on which the device is placed, as seen in FIG. 5 and FIG. 6.

A non-limiting example of a hair switch is a bundle of yarn, keratin fibers, human hair fibers, artificial hair fibers, thread, wool, or a combination of fibers.

A non-limiting example of the use of an adhesive for the attachment element is to place a cyanoacrylate type adhesive, a non-limiting example would be SUPER GLUE cyanoacrylate adhesive, on the closed end of the hair switch and to stick the closed end and adhesive to the back of the device in such a way that the switch may pass through the spreading element.

A non-limiting example of a pin as an attachment element involves a pin which is used to secure the closed end of the hair switch in place. The pin is located on the back side of the body of the device. The pin (a) is parallel to the plane that is defined by the surface of the back of the body of the device (of the two-dimensional silhouette), (b) is parallel to the plane defined by the X and Y axes, and (c) is perpendicular to the Z-axis.

A non-limiting example of a hook as the attachment element involves a hook mounted on the back of the body of the device. The hook is mounted in such a way that the closed end of the switch can be wedged tightly between the hook and the body of the device, holding it secure when demonstrating the hair switch.

A non-limiting example of a screw as the attachment element is to have a hole drilled and tapped into the body of the device to accept a screw. By backing out the screw, the operator is able to load the hair switch and tighten the screw to press the hair switch between the screw and the body of the device, holding the hair switch secure.

A non-limiting example of a nut and bolt as the attachment element is to have a bolt attached to the body of the device, such that the threaded end of the bolt points away from the face of the side of the body of the device that it is attached to. The operator can attach the hair switch to the bolt, and screw a nut down the bolt until the hair switch is pressed between the nut and the head of the bolt.

A non-limiting example of a pin as a spreading element involves a spring pin mounted close to the body of the device. The spring pin (a) is parallel to the plane that is defined by the surface of the back of the body of the device (of the two-dimensional silhouette), (b) is parallel to the plane defined by the X and Y axes, and (c) is perpendicular to the Z-axis. The spring pin is used to maintain the hair switch in a spread condition. When the spring pin is secured, the spring pin creates a narrow area between the pin and the body of the device, exerting pressure on the hair switch and forcing the fibers to maintain the spread condition. The spreading element is configured in such a way to enable the operator (a) to move the spring pin away from the body of the device to enable the hair switch to be positioned between the spring pin and the body of the device and then (b) to move the spring pin close to the body of the device so that the hair switch is squeezed between the spring pin and the body of the device in a spread condition.

A non-limiting example of adhesive as an attaching or spreading element is to use fugitive glue or another temporary adhesive to the area over which the hair switch is to be attached or spread. The operator may then attach or spread the hair switch on or over the area.

A non-limiting example of adhesive as an attachment or spreading element is to use cyanoacrylate glue or another permanent adhesive to attach the hair switch and/or to hold the hair switch in a spread condition.

A non-limiting example of the device in use is treating a hair switch with shampoo or another rinse-off hair product. The body of the device is attached to the base in a non-vertical slot which permits a 45° angle in relation to the horizontal plane. The device is then placed in or above a sink. This permits the operator to conveniently apply the product and rinse with water, simulating the way a person uses rinse-off products.

A further non-limiting example is treating a hair switch with a treatment product, non-limiting examples include a leave-on-treatment product, a hair spray, a mouse, or a gel product.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

In addition to the foregoing, the invention includes, as an additional aspect, all embodiments of the invention narrower in scope in any way than the variations specifically mentioned above. With respect to aspects of the invention described as a genus, all individual species are individually considered separate aspects of the invention. With respect to aspects of the invention described or claimed with "a" or "an," it should be understood that these terms mean "one or more" unless context unambiguously requires a more restricted meaning. With respect to elements described as one or more within a set, it should be understood that all combinations within the set are contemplated. If aspects of the invention are described as "comprising" a feature, embodiments also are contemplated "consisting of" or "consisting essentially of" the feature.

All documents cited in the Detailed Description of the Invention are, in relevant part, incorporated herein by reference; the citation of any document is not to be construed as an admission that it is prior art with respect to the invention. To the extent that any meaning or definition of a term in this document conflicts with any meaning or definition of the same term in a document incorporated by reference, the meaning or definition assigned to that term in this document shall govern.

While particular embodiments of the invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A device for displaying and demonstrating a hair switch comprising a. a body comprising a two-dimensional silhouette, having an upper and a lower end, a middle section, and a front and back side;

b. an attachment element which is selected from a group consisting of: a clamp, hook, adhesive, pin, screw, and nut and bolt;

c. a spreading element which is selected from a group consisting of: a clamp, pin, adhesive, and cap and groove; and d. a base wherein the base comprises at least one slot and the body comprises a tab which fits into the slot and wherein the slot in the base is non-vertical;

e. the hair switch;

wherein the attachment element is located on the back of the body;

and wherein the spreading element for the hair switch is located on the back of the body; and wherein the lower end of the body is attached to the base;

and wherein the hair switch has an open end and a closed end; and wherein the closed end of the hair switch is attached to the attachment element;

and wherein the hair switch is guided through the spreading element to be demonstrated in the desired width.

2. The device of claim 1, wherein the two-dimensional silhouette has the appearance of an item selected from a group consisting of: a human body, a part of human body, a human head, an animal body, a part of animal body, an animal head, a plant, and a building.

3. The device of claim 1, wherein the spreading element is a cap and groove.

4. The device of claim 1, wherein the angle of the slot in the base is from about 45 degrees to about 90 degrees in relation to the horizontal axis.

5. The device of claim 1, wherein the slot in the base is vertical.

6. The device of claim 1, wherein the cap has the appearance of a hat.

7. The device of claim 1, wherein the clamp is attached to the back of the body, and wherein the clamp is made to withstand more than 500 gf of applied force without releasing the hair switch.

8. The device of claim 1, wherein the clamp is attached to the back of the body, and wherein the clamp is made to withstand more than 1000 gf of applied force without releasing the hair switch.

9. The device of claim 1, wherein the clamp is attached to the back of the body, and wherein the clamp is made to withstand more than 5000 gf of applied force without releasing the hair switch.

10. The device of claim 1, wherein the clamp is attached to the back of the body, and wherein the clamp is made to withstand more than 10000 gf of applied force without releasing the hair switch.

11. The device of claim 1, wherein the body has the appearance of a tower, and the cap has the appearance of a window and an upper structure of said tower.

* * * * *